US005103984A

United States Patent [19]

Leyden et al.

[11] Patent Number: 5,103,984

[45] Date of Patent: Apr. 14, 1992

[54] SECURITY DEVICE FOR A GARMENT DISPLAY STRUCTURE

[75] Inventors: Roger J. Leyden, Willow Springs; Terrance Surma, Bloomingdale, both of Ill.

[73] Assignee: Se-Kure Controls, Inc., Chicago, Ill.

[21] Appl. No.: 664,121

[22] Filed: Mar. 4, 1991

[51] Int. Cl.[5] ..... A47F 5/00

[52] U.S. Cl. ..... 211/7; 211/4; 70/59; 70/60

[58] Field of Search ..... 211/7, 4, 123; 70/59, 70/60

[56] References Cited

U.S. PATENT DOCUMENTS 1,856,239 5/1932 Buckley ..... 211/4
4,540,092 9/1985 DeSantis ..... 211/4

FOREIGN PATENT DOCUMENTS 172028 6/1906 Fed. Rep. of Germany ..... 211/4
2550930 3/1985 France ..... 211/4

*Primary Examiner*—Robert W. Gibson, Jr.
*Attorney, Agent, or Firm*—Wood, Phillips, Mason, Recktenwald & VanSanten

[57] ABSTRACT

A security device for a garment display structure of the type having an elongate rail for supporting a garment-/security hanger, with the elongate rail having a free end with a first cross-sectional area taken transversely of the length thereof. The security device has a blocking element removably attached in an operative position adjacent to the free end of an elongate rail on a garment display structure to thereby create an effective cross-sectional area, taken transversely of the length of the elongate rail, that is greater than the first cross-sectional area. With the inventive structure, the blocking element prohibits the passage of certain garments/security hangers, that encircle the elongate rail, over and past the free end of the elongate rail, that could otherwise occur in the absence of the blocking element on the elongate rail.

22 Claims, 3 Drawing Sheets

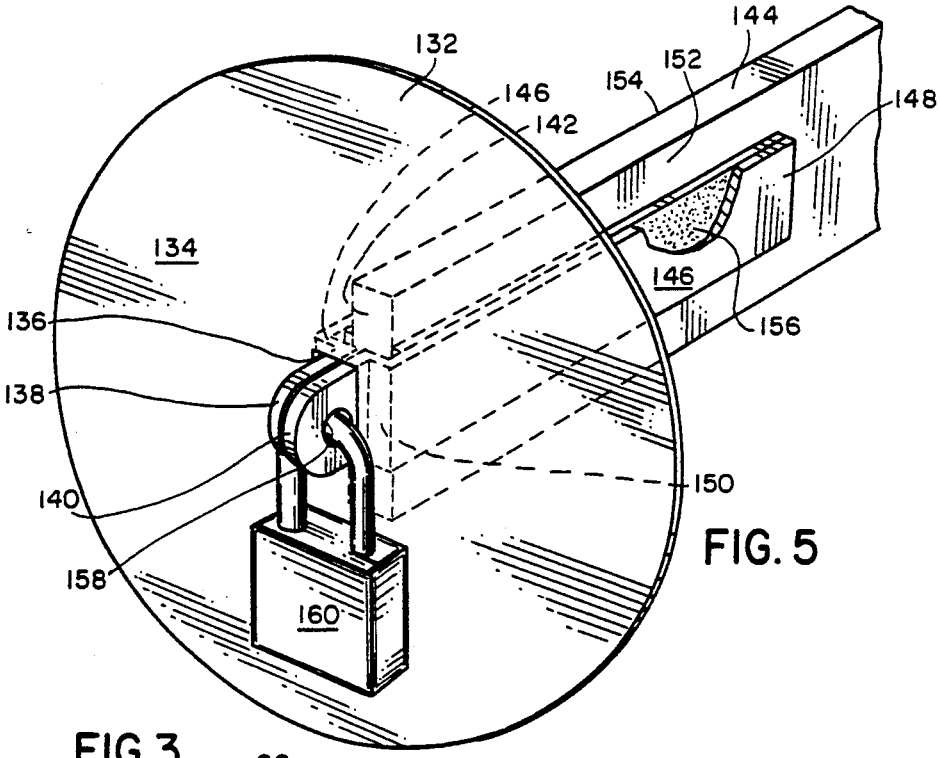
FIG. 5
FIG. 3
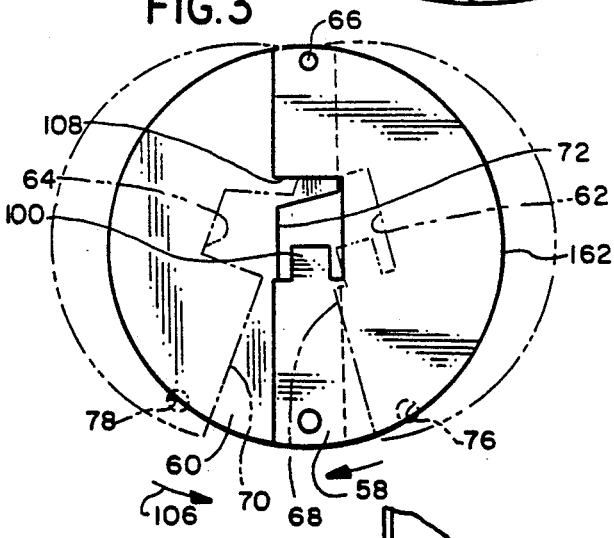
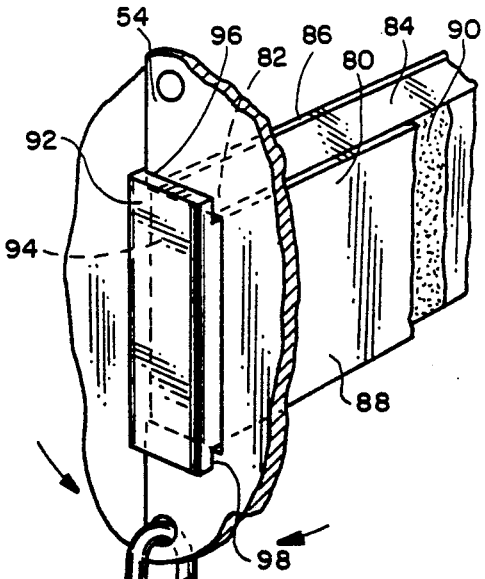
FIG. 6
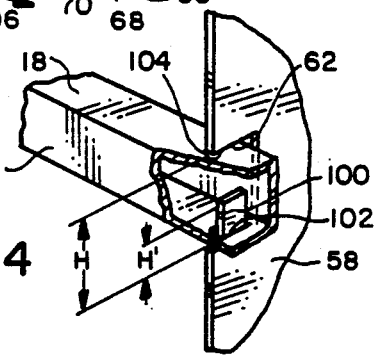
FIG. 4

SECURITY DEVICE FOR A GARMENT DISPLAY STRUCTURE

BACKGROUND OF THE INVENTION

1. Field of the Invention

This invention relates to garment display structures of the type having an elongate, horizontally directed rail for supporting a plurality of garments on hangers and, more particularly, to a security device for minimizing theft by prohibiting unauthorized separation of the garments from the display structure.

2. Background Art

The garment industry is particularly vulnerable to theft. The large number of thefts in the retail garment industry continues to impose a tremendous financial burden on the purveyors of those garments. The cost of stolen merchandise is ultimately passed on to the consumer by increasing the cost of the garments.

Most garments are placed on hangers supported on racks for permitting ready access to the garments at the point of purchase. The garments are commonly removed by potential purchasers who place the garments on to check for size and appearance. Commonly, the potential purchaser is unattended during this exercise. In high volume operations, it is difficult for store personnel to keep track of the individual garments. The result is that thieves often walk off with stolen garments without there even being a suspicion of the theft.

A number of different techniques have been developed in the garment industry to keep track of higher price garments, such as furs, at the point of purchase. One particularly effective system has been developed by Se-Kure Controls, Inc., the assignee of all rights in and to the present invention. Se-Kure Controls, Inc. has for many years sold a device which it identifies in the marketplace as the KOAT LOCK TM security device. The KOAT LOCK TM security device has been constructed from a single piece of hardened wire. The wire is formed with a large hoop at one end, a U-shaped bend at its opposite end, and a straight piece connecting therebetween. The U-shaped end is directed upwardly through the garment sleeve and is hung on an elongate rail which supports hangers for the garments. The legs of the U project beneath the rail. One leg of the U has a chain link connected thereto. The shackle of a padlock can be extended through the link and around the other leg to define a closed loop which prohibits removal of the U-shaped end from the rail. The hoop on the opposite end of the device prevents the garment sleeve from being slid off of the device which would then allow the garment to be separated from the display stand. The only way the garment can be removed intact is to unlock the padlock and then separate the security device, with the garment thereon, from the rail.

While the KOAT LOCK TM security device has proven to be very effective, it requires that both ends of the elongate rail on which the garments are supported, be constructed so that the security device cannot be shifted lengthwise off of the free end of the rail. This problem is encountered in a number of conventionally available garment display structures, particularly those which support the rail in cantilever fashion in either a horizontal orientation or in a 'waterfall'-type of display rack, in which the rail is inclined downwardly. In this latter construction, upwardly projecting knobs/lugs are provided on the rail to abut the individual hangers and thereby prevent sliding of the hangers off of the rail.

Consequently, absent some modification to the cantilever-type rails, the KOAT LOCK TM security device cannot be effectively used.

SUMMARY OF THE INVENTION

The present invention is specifically directed to overcoming the above enumerated problems in a novel and simple manner.

According to the present invention, a security device is provided for a garment display structure of the type having an elongate rail for supporting a garment-/security hanger, with the elongate rail having a free end with a first cross-sectional area taken transversely of the length thereof. The security device has a blocking element removably attached in an operative position adjacent to the free end of an elongate rail on a garment display structure to thereby create an effective cross-sectional area, taken transversely of the length of the elongate rail, that is greater than the first cross-sectional area. With the inventive structure, the blocking element prohibits the passage of certain garments/security hangers, that encircle the elongate rail, over and past the free end of the elongate rail, that could otherwise occur in the absence of the blocking element on the elongate rail.

It is the principal objective of the present invention to allow retrofitting of existing display structures with a security feature.

While the invention contemplates that the blocking element could be permanently affixed to a display structure, the removable aspect of the blocking element allows the purveyor to use the garment display structure selectively with and without a security feature.

In a preferred form, the blocking element is made up of first and second relatively movable parts. In one form, the first and second parts are pivotable relative to each other between a) a first assembly position, in which the blocking element can be placed over an elongate rail of a garment display structure, and b) a second locked position in which the blocking element is fixed relative to the elongate rail.

To maintain the blocking element parts in their locked position, a conventional padlock, or other like functioning mechanism, can be employed. Preferably, a bore is provided in each of the first and second blocking element parts, with the bores in the first and second parts being alignable with the blocking element parts in their locked position to allow passage therethrough of the shackle of a padlock.

In a preferred form, the first and second parts cooperatively define an opening for reception of the elongate rail. In one form, the peripheral edge of the blocking element extends continuously about the rail opening.

In one form of the invention, there is a tongue on one of the first and second blocking element parts for projection into an opening in an elongate rail on a garment display structure, to prevent lengthwise shifting of the blocking element with the blocking element in its operative position. Preferably, there is cooperating structure on the first and second blocking element parts and the elongate rail for preventing the tongue from withdrawing from the opening in the rail with the blocking element in its operative position and the first and second blocking element parts in their second, locked position.

In a preferred form, the other of the first and second blocking element parts has a cam edge for acting against the rail and progressively driving the blocking element tongue into the elongate rail opening as the blocking element parts are relatively moved from their assembly position into their locked position.

In one form of the invention, an enlargement is provided on the rail to prevent sliding of the blocking element over and past the rail free end. In a preferred form of the invention, the enlargement on the elongate rail is defined by an element that is separate from the rail body and attached thereto. Alternatively, the enlargement can be integrally formed on the rail. With the enlargement separately attached to the rail, a single piece blocking element can be assembled over the rail, after which the enlargement can be assembled to the rail.

The invention contemplates a combination of the security device with an elongate garment/security hanger support rail having a free end, with the blocking element being a flat element with an opening therethrough.

Preferably, at least one tab is provided on the elongate rail for projection in one direction through the opening in the flat element, with structure provided to be removably connected to the tab to prohibit the tab from being withdrawn from the opening in the flat element by movement oppositely to the one direction. Preferably, the elongate rail has laterally spaced sides with there being a plate with a tab on each of the elongate rail sides so that the tabs are extendable through the opening in the flat element. Preferably, each tab has a bore therethrough, with the bores being alignable to accept a locking element, such as a conventional-type padlock.

BRIEF DESCRIPTION OF THE DRAWINGS

FIG. 3 is a front elevation view of the blocking element shown in an assembly position in phantom lines and in a locked position in solid lines;

FIG. 4 is a perspective view of the blocking element on the rail of FIG. 2 with the rail partially broken away to show the connection between the blocking element and rail;

FIG. 5 is an enlarged perspective view of a modified form of blocking element and structure on a garment display rail for maintaining the blocking element on the garment display structure; and FIG. 6 is a view as in FIG. 5 showing the blocking element or FIGS. 1–4 on a modified garment display structure rail.

DETAILED DESCRIPTION OF THE DRAWINGS

Figure 1:
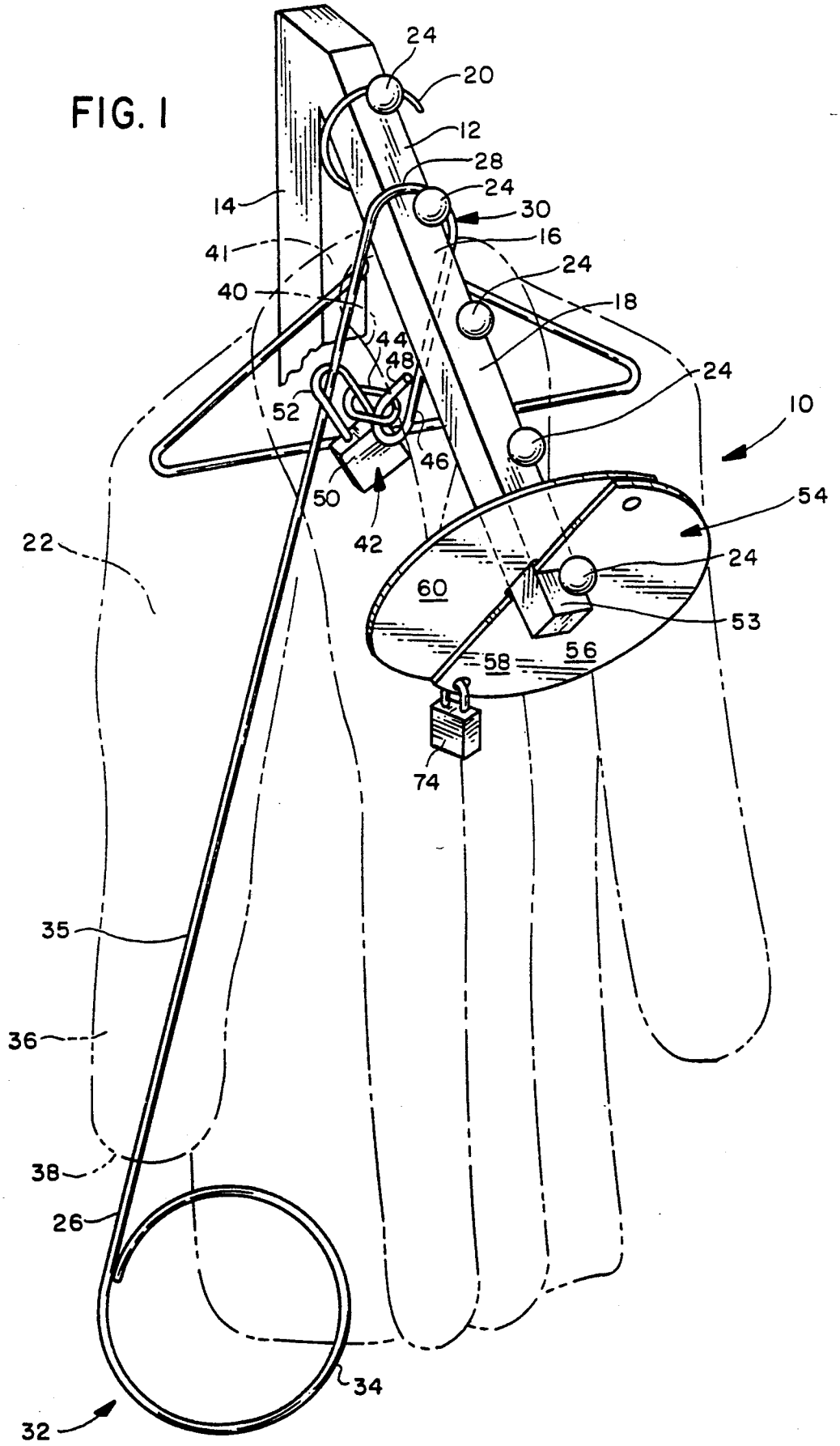
FIG. 1 is a perspective view of a garment display structure with an elongate rail having a coat supported thereon by a hanger/security device and further including a rail blocking element according to the present invention.

In FIG. 1, a security device, according to the present invention, is shown at 10 in its operative position on a "waterfall"-type garment display structure 12. The garment display structure 12 has a vertical support tube 14 from which an elongate rail 16 projects in cantilever fashion in a downwardly inclined orientation. The rail 16 provides an upwardly facing surface 18 for supporting hangers 20 (one shown), of conventional construction, on which garments can be hung for display. A coat 22 is shown for one of the garments. The rail 16 has regularly spaced knobs 24, fixedly attached to, and projecting upwardly from, the rail surface 18. Each knob 24 provides an abutment for the hangers 20, which slide down the surface 18 into engagement therewith.

To prevent unauthorized removal of the garment 22, a security hanger/device 26 is employed. The security device 26 depicted is manufactured and sold by Se-Kure Controls, Inc. and is identified as its KOAT LOCK TM security device. The security hanger 26 is defined by a single, formed length of heavy gauge, hardened wire. The hanger 26 has an inverted, U-shaped bend 28 at one end 30, an opposite end 32 bent into a large hoop 34, and a straight body 35 connecting between the ends 30, 32. The U-shaped bend 28 on the end 30 is dimensioned to be inverted and extendable over the rail 16, as shown in FIG. 1, and is sufficiently narrow to be extendable through the sleeve 36 on the garment 22. To assemble the security hanger 26, the end 30 thereof is directly upwardly into the open end 38 of the sleeve 36 of the garment 22 and through the sleeve 36 sufficiently that it projects out the neck opening 40 surrounded by the collar 41 of the garment 22. The U-shaped end 30 is then directed downwardly over the rail 16.

To secure the hanger 26 to the display structure 12, a locking means is provided at 42. The locking means includes a link 44 secured to one leg 46 of the "U" at the end 30 by extending the free end 48 of the leg 46 through the link 44 and doubling it back on itself. The locking means 42 further includes a padlock 50 with a shackle 52 that extends around the body 35 and through the link 44 to define at the end 30 an enclosed loop which encircles the rail 16. With the padlock 50 locked, the security hanger 26 is prohibited from being disengaged from the rail 16 and thereafter being pulled downwardly through the garment sleeve 36. The hoop 34 at the hanger end 32 is sufficiently large that the garment sleeve 36 cannot be drawn downwardly thereover for unauthorized removal of the garment. The only way that the garment 22 with the security hanger 26 attached can be removed is to disengage the hanger 26 from the rail 16 by first opening the padlock 50 or sliding the end 30 thereof lengthwise of the rail 16 over and past the rail free end 53.

The present invention is directed to structure for preventing unauthorized removal of garments by sliding of the security hanger 26 over and past the free end of a conventional garment display structure, such as that shown at 12 in FIG. 1. More specifically, the present invention is directed to a blocking element at 54, shown in FIGS. 1–4, to accomplish this end. The blocking element 54 consists of a generally flat disk 56 that is attachable to the rail 16 adjacent the free end 52 thereof. The blocking element 54 increases the effective cross-sectional area of the rail 16, taken transversely of its length, so as to thereby prohibit the sliding of the end 30 off of the free end 52 of the rail 16 as would release the garment 22.

More particularly, the blocking element 54 has first and second joinable parts 58, 60, respectively. Each of the parts 58, 60 is formed in a semi-circle so that when they are locked together in the operative position of FIG. 1, they cooperatively define a circular disc shape.

Each of the parts 58, 60 has a U-shaped opening 62, 64. The parts 58, 60 are connected together by a pivot pin 66 so that they are movable towards and away from each other in a scissoring action between a first, assembly position, shown in phantom in FIG. 3, and a second, locked position, shown in solid lines in FIG. 3. With the parts 58, 60 in the assembly position, the edges 68, 70 on the parts 58, 60, respectively, define a funnel-shaped opening to guide the rail 16 into alignment with the openings 62, 64. Once the rail 16 is aligned with the openings 62, 64, the plates 58, 60 are pivoted about the pin 66 to move the edges 68, 70 towards each other until the blocking element parts 58, 60 are in overlapped relationship, as shown in the solid line position in FIG. 3, corresponding to the locked position therefore. With the parts 58, 60 in their locked position, the openings 62, 64 cooperatively define a single, bounded opening 72, relatively closely matched to the size and shape of the cross section of the rail 16. The rail 16 is thus captively surrounded by the blocking element 54.

To maintain the blocking element parts 58, 60 in their locked and operative position, a padlock 74, or other suitable locking mechanism, is employed. The padlock 74 extends through bores 76, 78 in the plates 58, 60 at diametrically opposite locations to the pivot pin 66. The blocking element 54 is thus prohibited from moving transversely of the length of the rail 16.

The invention contemplates various structures for limiting sliding movement of the blocking element 54 lengthwise of the rail 16. In the FIG. 1 system, the outermost knob 24 blocks passage of the blocking element 54 over and past the rail free end 52. With this type of rail arrangement, the blocking element openings 62, 64 can be made identical and simply rectangular or square. This arrangement allows the blocking element 54 to shift freely lengthwise between the outermost and adjacent knobs 24.

Such a sliding arrangement is also facilitated by the structure shown in FIG. 6. In FIG. 6, an adapter 80 is provided at the free end 82 of a rail 84. The adapter 80 has integral side plates 86, 88 spaced to closely accept the width of the rail 84. An adhesive 90 is used to secure each side plate 86, 88 of the adapter 82 to the rail 84. The side plates 86, 88 are joined by an enlargement/web 92 which abuts the free end 94 of the rail 84 to provide upper and lower shoulders 96, 98, which abut the blocking element 54 to prevent its movement past the rail free end 94.

The invention also contemplates attachment of the blocking element 54 to the free end of a rail without the need for a knob 24 or enlargement such as the adapter 80. Such alternative structure is shown in FIGS. 3 and 4. On one of the blocking element parts 58, a tongue 100 is formed. The tongue 100 is configured to project into an opening 102 in the rail 16. To facilitate use of the tongue 100, the vertical dimension H of the opening 62 must be at least as large as the height H' of the tongue 100 plus the height of the rail. This allows the downwardly facing edge 104, bounding the top of the opening 62, to be placed against the rail surface 18, whereupon the blocking element 54 can be slid lengthwise of the rail 16 to allow the tongue 100 to align with the rail opening 102. The tongue 100 can then be directed into the opening 102 by shifting the blocking element part 58 upwardly relative to the rail 16. The other blocking element part 60 is then pivoted in the direction of arrow 106 in FIG. 3 to the locked position. As this occurs, a cam edge 108 engages the upper rail surface 18 and, as the part 60 moves towards its locked position, progressively cams the blocking element 54 upwardly to thereby drive the tongue 100 fully into the receptive opening 102. The seated tongue 100 thereby prohibits lengthwise shifting of the blocking element 54 along the rail 16.

Figure 2:
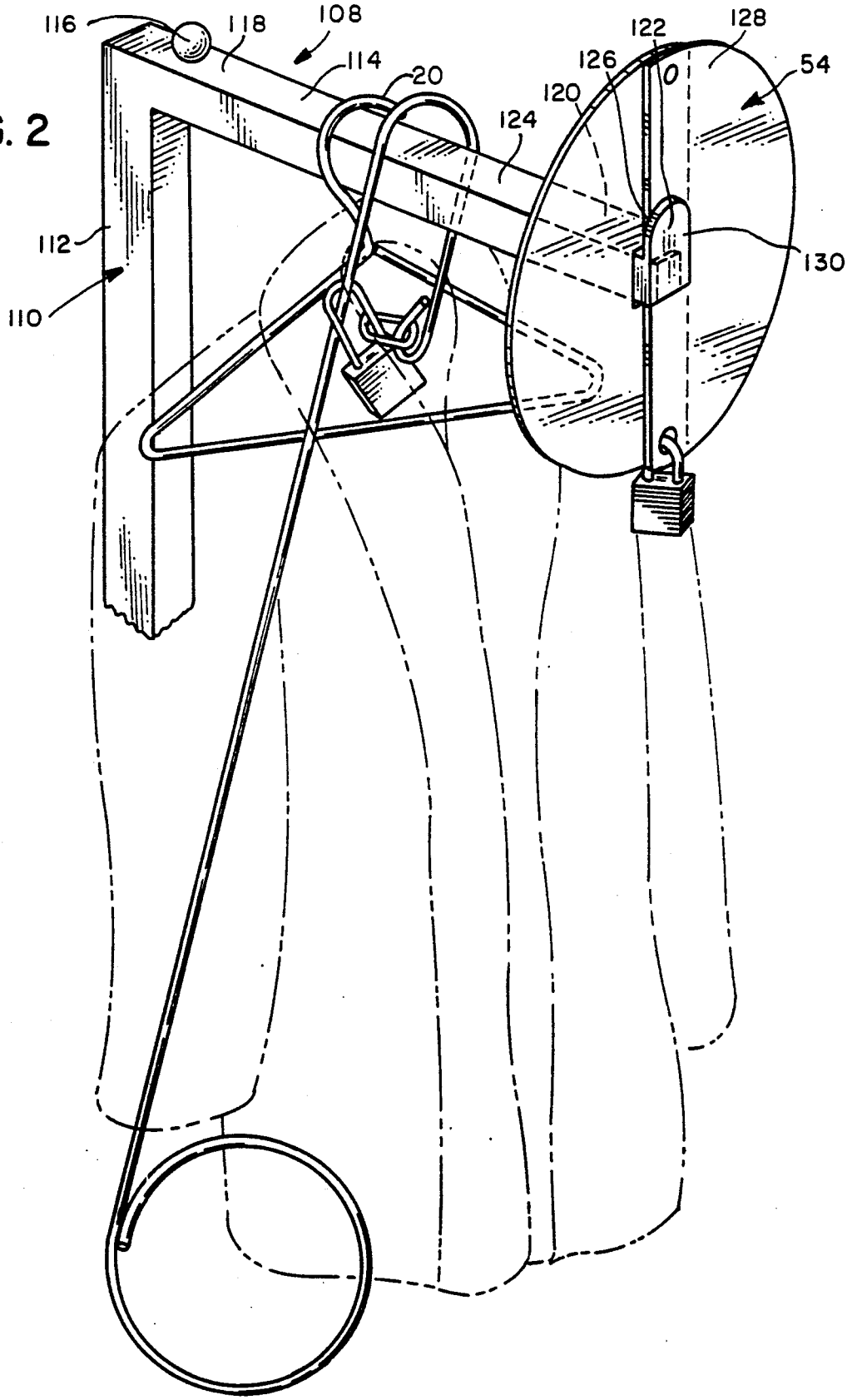
FIG. 2 is a view similar to that in FIG. 1 with a modified type of garment display structure.

A further modification of the invention is shown in a system at 108 in FIG. 2. In FIG. 2, a garment display structure is shown at 110 including a vertical support 112 with a horizontal rail 114 projecting in cantilever fashion therefrom. A knob 116 is provided at the rail end 118, adjacent to the vertical support 112, to limit sliding of garment hangers 20 in a direction towards the vertical support 112. On the opposite rail end 120, an enlargement 122 is integrally formed. The enlargement 122 projects vertically upwardly from the rail body 124 to provide a vertical abutting shoulder 126 for the blocking element 54.

The blocking element 54 is assembled to the rail 114 as described with respect to FIGS. 3 and 4. The abutting shoulder 126 on the enlargement 122 prevents outward tilting of the upper part 128 of the blocking element 54. This allows the blocking element 54 to be placed closely adjacent to the free end 130 of the rail 114 without fear that it might be worked loose by one attempting to remove the garments from off of the rail 114.

A further modification of the inventive structure is shown in FIG. 5. The blocking element 132 in FIG. 5 consists of a circular, one-piece, flat disk 134 with a central opening 136. The opening 136 accepts two tabs 138, 140, which project beyond the free end 142 of the rail 144.

The tabs 138, 140 are defined on identical adapter plates 146. Exemplary adapter plate 146 has an elongate body 148, an offset 150, and one tab 140. One plate 146 is provided on each side surface 152, 154 of the rail 144 and secured thereto as by an adhesive 156. The offsets 150 abut the free end 142 of the rail 144. The tabs 138, 140 have aligned bores 158 (one shown), which accept a locking element, such as a padlock 160.

To mount the blocking element 132, the plates 146 are preassembled to the rail 144. The tabs 138, 140 are then directed in one direction through the center opening 136 of the blocking element 132 to place the back side surface 160 of the disk 134 against the free end 142 of the rail 144. In this position, the tabs 138, 140 project completely through the center opening 136 to fully expose the bores 158. The padlock 160 is then attached to prohibit the disk 134 from being drawn off of the tabs 138, 140.

The invention contemplates various modifications of the structures disclosed. For example, the shape of the disk is purely a design consideration. It need not be circular, as shown in the drawings. Further, the opening 72 in the blocking element 54 need not be entirely within a peripheral edge 162 on the blocking element 54, as shown. Still further, the various arrangements shown to prevent movement of the blocking elements 54, 132 off of the rails 16, 84, 114, 144 should not be viewed as limiting.

The present invention has particular utility in retrofitting conventional type garment display structures, such as those shown in FIGS. 1 and 2.

The foregoing disclosure of specific embodiments is intended to be illustrative of the broad concepts comprehended by the invention.

We claim:

1. A security device for a garment display structure of the type having an elongate rail for supporting a garment/security hanger, said elongate rail having a free end with a first cross-sectional area taken transversely of the length of the elongate rail, said security device comprising:

a blocking element; and means removably attaching the blocking element in an operative position adjacent to the free end of an elongate rail on a garment display structure to thereby create an effective cross-sectional area taken transversely of the length of the elongate rail that is greater than the first cross-sectional area, said blocking element prohibiting the passage of certain garment/security hangers that encircle the elongate rail over and past the free end of the elongate rail that could otherwise occur in the absence of said blocking element on the elongate rail, said blocking element comprising a substantially flat element with an opening therethrough to accept an elongate rail for supporting a garment/security hanger.

2. The security device according to claim 1 wherein the blocking element comprises first and second relatively movable parts.

3. The security device according to claim 1 wherein the blocking element comprises first and second relatively movable flat parts and means for connecting the first and second parts, one to the other, for relative pivoting movement between a) a first assembly position in which the blocking element can be placed on an elongate rail of a garment display structure and b) a second locked position in which the blocking element is fixed relative to the elongate rail.

4. The security device according to claim 3 including means on the blocking element for maintaining the blocking element parts in their locked position.

5. A security device for a garment display structure of the type having an elongate rail for supporting a garment/security hanger, said elongate rail having a free end with a first cross-sectional area taken transversely of the length of the elongate rail, said security device comprising:

a blocking element; and means for removably attaching the blocking element in an operative position adjacent to the free end of an elongate rail on a garment display structure to thereby create an effective cross-sectional area taken transversely of the length of the elongate rail that is greater than the first cross-sectional area, said blocking element prohibiting the passage of certain garment/security hangers that encircle the elongate rail over and past the free end of the elongate rail that could otherwise occur in the absence of said blocking element on the elongate rail;

wherein the blocking element comprises first and second parts and means for connecting the first and second parts, one to the other, for relative pivoting movement between a) a first assembly position in which the blocking element can be placed on an elongate rail of a garment display structure and b) a second locked position in which the blocking element is fixed relative to the elongate rail, said security device further including means on the blocking element for maintaining the blocking element parts in their locked position, wherein the maintaining means comprises a bore in each of the first and second blocking element parts, said bores in the first and second blocking element parts being alignable with the blocking element parts in their locked position.

6. The security device according to claim 5 wherein said maintaining means further includes a padlock for extension through the bores in the first and second blocking element parts.

7. A security device for a garment display structure of the type having an elongate rail for supporting a garment/security hanger, said elongate rail having a free end with a first cross-sectional area taken transversely of the length of the elongate rail, said security device comprising:

a blocking element; and means for removably attaching the blocking element in an operative position adjacent to the free end of an elongate rail on a garment display structure to thereby create an effective cross-sectional area taken transversely of the length of the elongate rail that is greater than the first cross-sectional area, said blocking element prohibiting the passage of certain garment/security hangers that encircle the elongate rail over and past the free end of the elongate rail that could otherwise occur in the absence of said blocking element on the elongate rail, wherein the blocking element comprises first and second parts that are relatively movable between a) a first assembly position and b) a second locked position, said first and second parts in their locked position having a peripheral edge and defining an opening residing within said peripheral edge for reception of an elongate rail on a garment display structure.

8. The security device according to claim 7 wherein at least one of said first and second blocking member parts has a tongue thereon for projection into an opening in an elongate rail on a garment display structure with the blocking element in its operative position.

9. The security device according to claim 7 wherein the peripheral edge extends continuously about the rail receiving opening in the blocking element.

10. The security device according to claim 1 in combination with an elongate garment/security hanger support rail having a free end, said blocking element comprising first and second parts that are relatively movable between a) a first assembly position and b) a second locked position.

11. A security device for a garment display structure of the type having an elongate rail for supporting a garment/security hanger, said elongate rail having a free end with a first cross-sectional area taken transversely of the length of the elongate rail, said security device comprising:

a blocking element; and means for removably attaching the blocking element in an operative position adjacent to the free end of an elongate rail on a garment display structure to thereby create an effective cross-sectional area taken transversely of the length of the elongate rail that is greater than the first cross-sectional area, said blocking element prohibiting the passage of certain garment/security hangers that encircle the elongate rail over and past the free end of the elongate rail that could otherwise occur in the absence of said blocking element on the elongate rail, said security device being in combination with an elongate garment/security hanger support rail having a free end, said blocking element comprising first and second parts that are relatively movable between a) a first assembly position and b) a second locked position, wherein said elongate rail has a body with an enlargement adjacent to the free end of the elongate rail, said blocking element in its second locked position defining an opening for reception of the elongate rail body, said opening being dimensioned to prevent passage therethrough of the enlargement on the elongate rail.

12. The security device according to claim 10 wherein one of the first and second parts has a tongue for reception in an opening in the elongate rail and there are cooperating means on the first and second blocking element parts and elongate rail for preventing the tongue on the blocking element from withdrawing from the opening in the elongate rail with the blocking element in its operative position and the first and second blocking element parts in their second locked position.

13. A security device for a garment display structure of the type having an elongate rail for supporting a garment/security hanger, said elongate rail having a free end with a first cross-sectional area taken transversely of the length of the elongate rail, said security device comprising:

a blocking element; and means for removably attaching the blocking element in an operative position adjacent to the free end of an elongate rail on a garment display structure to thereby create an effective cross-sectional area taken transversely of the length of the elongate rail that is greater than the first cross-sectional area, said blocking element prohibiting the passage of certain garment/security hangers that encircle the elongate rail over and past the free end of the elongate rail that could otherwise occur in the absence of said blocking element on the elongate rail, said security device being in combination with an elongate garment/security hanger support rail having a free end, said blocking element comprising first and second parts that are relatively movable between a) a first assembly position and b) a second locked position, wherein one of the first and second parts has a tongue for reception in an opening in the elongate rail and there are cooperating means on the first and second blocking element parts and elongate rail for preventing the tongue on the blocking element from withdrawing from the opening in the elongate rail with the blocking element in its operative position and the first and second blocking element parts in their second locked position, wherein the other of the first and second blocking element parts has a cam edge for acting against the rail and progressively driving the blocking element tongue into the elongate rail opening as the blocking element parts are relatively moved from their assembly position into their locked position.

14. The security device according to claim 11 wherein the enlargement is defined by a first adapter element that is separate from the rail body and including means for attaching the first element to the elongate rail body.

15. A security device for a garment display structure of the type having an elongate rail for supporting a garment/security hanger, said elongate rail having a free end with a first cross-sectional area taken transversely of the length of the elongate rail, said security device comprising:

a blocking element; and means for removably attaching the blocking element in an operative position adjacent to the free end of an elongate rail on a garment display structure to thereby create an effective cross-sectional area taken transversely of the length of the elongate rail that is greater than the first cross-sectional area, said blocking element prohibiting the passage of certain garment/security hangers that encircle the elongate rail over and past the free end of the elongate rail that could otherwise occur in the absence of said blocking element on the elongate rail, said security device being in combination with an elongate garment/security hanger support rail having a free end, said blocking element comprising a flat element with an opening therethrough.

16. The security device according to claim 15 wherein the means for removably attaching comprises at least one tab on the elongate rail for projection in one direction through the opening in the flat element and includes means removably connected to the one tab for prohibiting the tab from being withdrawn from the opening in the flat element by movement oppositely to the one direction with the means removably connected to the one tab connected to the one tab.

17. The security device according to claim 16 wherein the elongate rail has laterally spaced sides, there is an adapter plate with a tab on each of the elongate rail sides so that the tabs on each of the plates are extendable through the opening in the flat element.

18. The security device according to claim 17 wherein each said tab has a bore therethrough and the means for removably attaching the blocking element includes a locking means for extension through the tab bores and defining an enlargement that will not pass through the opening in the flat element.

19. A security device for a garment display structure of the type having an elongate rail for supporting a garment/security hanger, said elongate rail having a cross-sectional area, the garment security device comprising:

a blocking element; and means for attaching the blocking element in an operative position wherein it extends completely around an elongate rail on a garment display structure to thereby create an effective cross-sectional area that is greater than the cross-sectional area of the elongate rail adjacent to where the blocking element is attached, said blocking element comprising a substantially flat element with an opening therethrough to accept an elongate rail for supporting a garment/security hanger.

20. The security device according to claim 19 wherein the blocking element comprises first and second relatively movable parts.

21. A security device for a garment display structure of the type having an elongate rail for supporting a garment/security hanger, said elongate rail having a cross-sectional area, the garment security device comprising:

a blocking element; and means for attaching the blocking element in an operative position to an elongate rail on a garment display structure to thereby create an effective cross-sectional area that is greater than the cross-sectional area of the elongate rail adjacent to where the blocking element is attached, wherein the attaching means comprising means for removably attaching the blocking element to an elongate rail, wherein the blocking element comprises first and second relatively movable parts, wherein said first and second parts are movable relative to each other between assembly and locked positions, each said blocking element part has a U-shaped opening for reception of a part of an elongate rail and with the first and second blocking element parts in their locked position the rail is captively held in an opening defined cooperatively by the U-shaped openings between the first and second blocking element parts.

22. The security device according to claim 21 wherein the first and second blocking element parts are pivotably connected each to the other at a first location, there is a bore in each of the first and second blocking element parts and with the blocking element parts in their locked position the bores in the first and second plates align at a second location that is diametrically opposite to the first location.

* * * * *